United States Patent [19]

Nohira et al.

[11] 4,092,960

[45] June 6, 1978

[54] EXHAUST GAS RECIRCULATION SYSTEM IN AN INTERNAL COMBUSTION ENGINE

[75] Inventors: Hidetaka Nohira; Masaaki Tanaka, both of Susono, Japan

[73] Assignee: Toyota Jidosha Kogyo Kabushiki Kaisha, Toyota, Japan

[21] Appl. No.: 743,145

[22] Filed: Nov. 18, 1976

[30] Foreign Application Priority Data

Jun. 18, 1976 Japan ..... 51-78896[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,802,402 | 4/1974 | Swatman | 123/119 A |
| 3,834,366 | 9/1974 | Kingsbury | 123/119 A |
| 3,881,456 | 5/1975 | Nohira | 123/119 A |
| 3,896,777 | 7/1975 | Masaki et al. | 123/119 A |
| 3,926,161 | 12/1975 | Wertheimer | 123/119 A |
| 4,013,052 | 3/1977 | Masaki et al. | 123/119 A |
| 4,033,308 | 7/1977 | Hayashi et al. | 123/119 A |
| 4,041,917 | 8/1977 | Suzuki | 123/119 A |

*Primary Examiner*—Wendell E. Burns
*Assistant Examiner*—William Randolph
*Attorney, Agent, or Firm*—Stevens, Davis, Miller & Mosher

[57] ABSTRACT

A back pressure-controlled EGR system in an internal combustion engine comprising an EGR valve means with a pressure control chamber disposed in an EGR conduit connecting an exhaust pipe to an intake pipe of the engine, and a back pressure transducer having a sub-atmospheric pressure chamber connected to said EGR valve means and having a pressure operation chamber connected to said pressure control chamber, said sub-atmospheric chamber being connected to the atmospheric air via an air bleed passage which is connected to a venturi portion of a carburetor via a branch pipe.

2 Claims, 4 Drawing Figures

EXHAUST GAS RECIRCULATION SYSTEM IN AN INTERNAL COMBUSTION ENGINE

This invention relates to an exhaust gas recirculation system (EGR system) for decreasing an amount of nitrogen oxides ($NO_x$) contained in the exhaust gas in an internal combustion engine, and relates in particular to an improved back pressure-controlled EGR system.

There is known a back pressure-controlled EGR system comprising an EGR control valve means with a diaphragm chamber provided on an EGR conduit connecting the intake pipe or manifold to the exhaust pipe or manifold of the engine, a pressure control chamber arranged in the upstream or inlet side of the EGR control valve means, an orifice means provided on a conduit connecting the diaphragm chamber of the EGR control valve means to an EGR port which is opened in the carburetor and near the throttle blade of the carburetor, an air bleed passage diverging from said last-mentioned conduit and a pressure control valve means (a back pressure transducer) provided at the open end of the air bleed passage. In such a known EGR system, said pressure control valve means comprises two chambers separated from one another by a diaphragm, one of which is opened into the atmosphere and the other of which is connected to said pressure control chamber. The EGR system is operated in such a way that the pressure of the pressure control chamber is maintained constant with the help of the pressure control valve means to control the EGR flow rate. Therefore, the EGR rate, i.e., the rate of the amount of the recirculated exhaust gas to the total amount of the exhaust gas is constant and independent of the load conditions of the engine, that is, throughout the operating conditions of the engine. This, however, presents such a problem that even during a low load condition of the engine the same EGR rate of the exhaust gas as that existing during a high load condition of the engine, which requires a relatively large EGR rate to purify the exhaust gas, or to reduce the $NO_x$ concentration in the exhaust gas, is recirculated resulting in a decrease in the engine power and in an unstable engine.

The main object of the present invention is to solve the above-mentioned problem. There is provided, according to the present invention, an EGR system comprising an improved pressure control valve means with a sub-atmospheric chamber which is opened into the atmosphere by way of an air bleed passage and is also connected to the venturi portion of the carburetor through a passage diverging from the air bleed passage.

Figure 1:
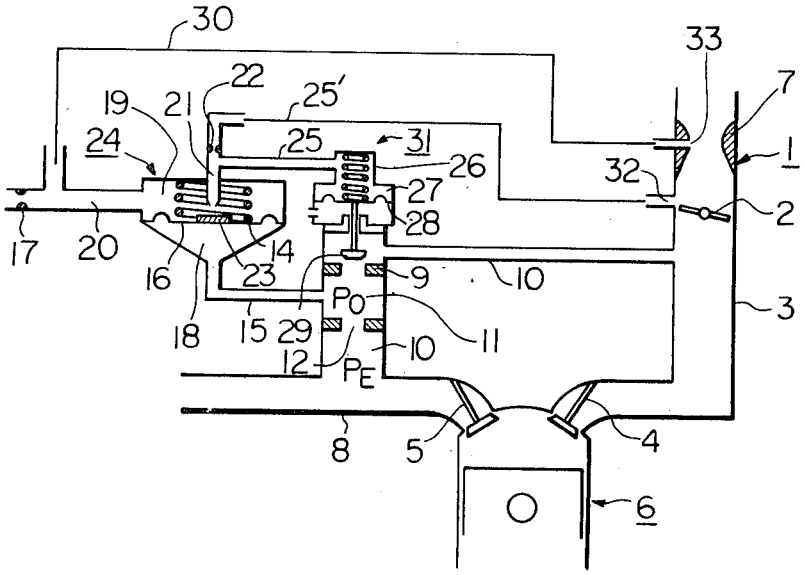
Figure 2A:
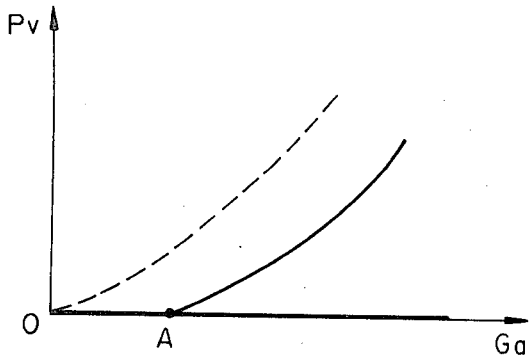
Figure 2B:
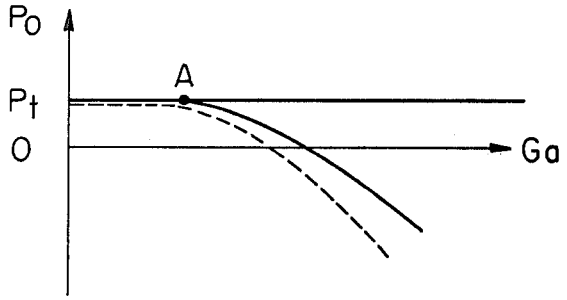
Figure 2C:
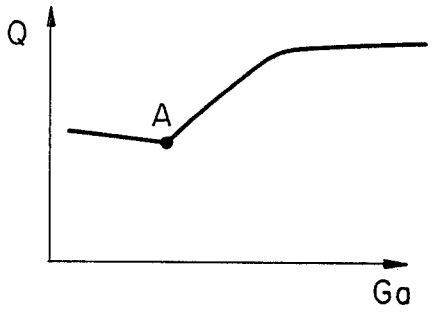

Other features, additional objects, and many of the attendant advantages of this invention will readily be appreciated as they become better understood by referring to the following detailed description of the preferred embodiment when considered in connection with the appended drawings in which:

FIG. 1 schematically shows an EGR system according to the present invention;

FIGS. 2A, 2B and 2C are diagrams showing control characteristics of the EGR system of the present invention.

FIG. 1 is a diagram illustrating the EGR system of the present invention, in which reference numerals 1, 2, 6, 4, 5 and 7 represent a carburetor, a throttle blade an engine body, an intake valve, an exhaust valve and a venturi, respectively. A diaphragm type EGR control valve means 31 is disposed on an EGR conduit 10 connecting an exhaust pipe 8 to an intake pipe 3. A pressure control chamber (or constant-pressure chamber) 11 is formed on the inlet side of this EGR control valve means. The inlet of this pressure control chamber 11 is defined by an orifice 12. A diaphragm chamber 27 of the EGR control valve means 31 is communicated with an EGR port 32 disposed in the vicinity of the throttle blade of the carburetor 1 through communicating pipes or pressure sensing pipes 25 and 25'. Reference numerals 26, 28 and 29 represent a spring, a diaphragm and a valve, respectively. FIG. 1 illustrates the open state where the valve 29 is separated from a valve seat 9. An orifice 22 is mounted on the communicating pipe 25, a passage 21 for opening to atmospheric air is branched from the communicating pipe 25 between the orifice 22 and the EGR control valve means 31, and a back pressure transducer 24 is disposed on the open end of the passage 21. This back pressure transducer 24 has two chambers 18 and 19 partitioned by a diaphragm 16. The operation chamber 18 is connected to the pressure control chamber 11 through a path 15, and the chamber 19 is opened to atmospheric air through an air bleeding passage 20. The diaphragm 16 has a valve 23 and is urged toward the operation chamber 18 by means of a spring 14. The valve 23 controls the opening and the closing of the above passage 21 for opening to the atmospheric air. A communicating passage 30 is branched from the air bleeding passage 20 downstream of a bleed 17 and extended to a control port 33, whereby the chamber 19 to be opened to the atmospheric air is communicated with the venturi 7 of the carburetor. For example, the EGR port 32 is designed so that it is located just upstream of the throttle blade 2 when the opening of the throttle blade 2 is that of idling. The diaphragm chamber 27 of the EGR control valve means 31 may be introduced into a vacuum region other than the intake pipe, such as a vacuum region of an engine driven or an electrically motor-driven vacuum pump. Further, it is possible to introduce the diaphragm chamber 27 of the EGR control valve means 31 into an extrusion pressure region of an air pump (not shown) and actuate the diaphragm chamber 27 in response to the extrusion pressure (positive pressure) of the pump.

The EGR system of the present invention having the above structure is operated in the following manner.

When the throttle blade 2 is closed of the engine is in the idling state, the atmospheric pressure acts on the EGR port 32, and therefore, the atmospheric pressure also acts on the diaphragm chamber 27 of the EGR control valve means 31 through the communicating pipe 25. Accordingly, the diaphragm 28 is pushed downwardly and the valve 29 cooperating therewith is also lowered. Hence, the EGR control valve is closed and no exhaust gas is recirculated.

When the opening of the throttle blade 2 is increased and slightly exceeds the position of the EGR port 32, namely, when the engine is in the light load running state, the intake vacuum acts on the EGR port 32. Accordingly, if the pressure control valve 24 is closed by the valve 23, the vacuum also acts on the diaphragm chamber 27, and thus the diaphragm 28 is lifted up. Further, the valve 29 rises, and the EGR control valve means 31 is opened to recirculate a part of the exhaust gas. At this point, if the opening of the valve 29 is excessively increased and the amount of the recirculated exhaust gas becomes too large, since the pressure in the pressure control chamber 11 is reduced, then the pressure in the operation chamber 18 of the back pressure transducer 24 which is communicated with the pressure control chamber 11 is also reduced to shift down the valve 23 together with the diaphragm 16. Accordingly, the passage 21 is communicated with the atmospheric air through the air bleeding passage 20, and the atmospheric pressure acts on the diaphragm chamber 27 of the EGR control valve means 31. As a result, the valve 29 is lowered and the EGR control valve means 31 prepares to close. At this point, if the opening of the valve 29 is reduced and the amount of the recirculated exhaust gas is made smaller, the pressure in the pressure control chamber 11 is elevated. Accordingly, the pressure in the operation chamber 18 of the back pressure transducer 24 which is communicated with the pressure control chamber 11 is also elevated; the valve 23 undergoes an upward force; and the back pressure transducer 24 is closed. Accordingly, vacuum from the EGR port 32 again acts on the diaphragm chamber 27 of the EGR control valve means 31 causing the valve 29 to lift up and the amount of the recirculated exhaust gas to be increased. In the foregoing manner, the opening of the EGR control valve means 31 is adjusted so that the pressure in the pressure control chamber 11 is substantially maintained at a certain sub-atmospheric pressure, approximating atmospheric pressure, which corresponds to the amount of air varied depending on the degree of opening of the throttle blade 2. Namely, if the amount of the recirculated exhaust gas is too large, the opening of the EGR control valve means 31 is reduced and if the amount of the recycled exhaust gas is too small, the opening of the EGR control valve means 31 is increased, whereby the amount of recirculated exhaust gas is automatically controlled at a constant rate to the amount of the intake air.

The chamber 19 of the back pressure transducer 24 is opened to atmospheric air through the air bleeding passage 20 as pointed out hereinbefore, and simultaneously, it is communicated with the venturi of the carburetor through the communicating passage 30. The venturi pressure is substantially equal to atmospheric pressure when the opening of the throttle blade 2 is small. Accordingly, when the opening of the throttle blade 2 is small, the atmospheric pressure acts on the chamber 19, and the diaphragm 16 and the valve 23 fixed thereto undergo a slightly small downward force. Therefore, in order to close the back pressure transducer 24, a little higher pressure should be applied to the operation chamber 18 and in turn to the pressure control chamber 11. In other words, the opening of EGR control valve means 31 is controlled so that a little higher pressure is maintained in the pressure control chamber 11. The fact that the pressure in the pressure control chamber 11 is slightly high means that the amount of the recirculated exhaust gas is small. Therefore, during light load running, the recirculation rate of the recirculated exhaust gas is controlled to a relatively low level.

When the opening of the throttle valve 2 is further increased, vacuum on the venturi 7 of the carburetor 1 is elevated. Accordingly, the amount of air bled through the air bleeding passage 20 is reduced, and the pressure in the chamber 19 to be opened to atmospheric air is reduced to a vacuum. Therefore, the vacuum in the operation chamber 18 of the back pressure transducer 24 becomes slightly smaller when compared to the atmospheric pressure, provided that the previously mentioned operation of the back pressure transducer 24, control valve means 31 and pressure control chamber 11 is actuated. As a result, the same vacuum as maintained in the operation chamber 18 is maintained in the pressure control chamber 11, and hence, the amount of the exhaust gas flown into the pressure control chamber 11 from the exhaust pipe 8 is increased. Namely, in the state where the opening of the throttle valve 2 is increased, control is made so that the amount of the recirculated exhaust gas is increased.

In principle when the venturi vacuum acts on the chamber 19 via the communicating passage 30, the pressure in the chamber 19 is replaced by a modified venturi vacuum the level of which is modified by the function of the air bleed 17, resulting in an upward displacement of the diaphragm 16 against the force of the weak spring 14. Consequently, the valve 23 can also be closed when the pressure in the chamber 18 and, accordingly, in the pressure control chamber 11 is not sufficiently high enough to displace the diaphragm 16 upwardly; thereby no air is bled through the passage 21. It should be noted that the flow rate Q of the recirculated gas is generally given by the following equation.

$$Q \doteqdot CA\sqrt{P_E - P_O} \qquad (1)$$

wherein $C$ is a flow coefficient; $A$ is a cross-sectional area of the orifice 12; and $P_E$ and $P_O$ are pressures in the upstream and downstream of the orifice 12, respectively.

Usually, $P_O$ is nearly equal to zero ($P_O \simeq 0$), whereas $P_E$ is considerably larger than $P_O$ ($P_E \gg P_O$); therefore, the equation (1) can be substantially replaced by the following equation (2).

$$Q = CA\sqrt{P_E} \qquad (2)$$

Since $P_E$ is proportional to a square number of the amount $G_a$ of the intake air ($P_E \propto G_a^2$), then Q is proportional to $G_a$ ($Q \propto G_a$). That is, the flow rate of Q of the recirculated gas is proportional to the amount $G_a$ of the intake air.

According to the present invention, as mentioned above, when the pressure in the chamber 19 is replaced by the venturi vacuum $P_v$ or by the above-mentioned air bleed-modified venturi vacuum $P_v'$, $Q = CA\sqrt{P_E - P_O}$ becomes $Q = CA\sqrt{P_E - (P_O + P_v)}$ or $Q = CA\sqrt{P_E - (P_O + P_v')}$. In view of $P_v$ and $P_v'$ being negative pressure, and $P_O$ being nearly equal to zero $$Q = CA\sqrt{P_E + = P_v =}$$

or $$Q = CA\sqrt{P_E + = P_v' =}$$

the flow rate Q of the recirculated gas is increased when the venturi vacuum of the air bleed-modified venturi vacuum acts on the chamber 19.

When the intake vacuum corresponding to the amount of air varied depending on the degree of opening of the throttle blade 2 is caused to act on the back pressure transducer 24 in the above-mentioned manner, the pressure in the pressure control chamber 11 on the inlet side of the EGR control valve in the EGR system need not be maintained at the same level during all of the engine running stages, but this pressure may be changed to an appropriate level corresponding to the opening of the throttle valve. Accordingly, it is possible to recirculate a large amount of the exhaust gas during high load running requiring a high exhaust gas recirculation rate. During light load running, it is possible to reduce the exhaust gas recirculation rate and to increase the output, whereby the running efficiency can be remarkably improved.

The effect of the air bleed 17 will now be described by referring to FIGS. 2-A, 2-B, and 2-C.

FIGS. 2-A, 2-B and 2-C are curves showing control characteristics of the EGR system of the present invention. FIG. 2-A illustrates the relation between the amount Ga of intake air and the vacuum Pv of the chamber 19 of the back pressure transducer 24. The broken line shows results obtained when the air bleed 17 is not employed and the solid line shows results obtained when the air bleed 17 is employed. When the chamber 19 is opened to the atmospheric air through the air bleed 17 according to the present invention, with an increase of the amount Ga of intake air, the venturi vacuum and in turn the vacuum $P_v$ of the chamber 19 to be opened to the atmospheric air are enhanced, but since the air bleed 17 is provided, the atmospheric pressure is maintained in the chamber 19 for a while. After a lapse of a certain quantity of intake air, namely after point A in FIG. 2-A, vacuum is attained in the chamber 19. Accordingly, the air bleed 17 performs the function wherein the position of point A is shifted. The position of point A can be changed by appropriately selecting the size of the bleeding hole. In the case where no air bleed is provided, $P_v$ is increased in proportion to the increase of $G_a$ as clearly indicated by the broken line.

FIG. 2-B illustrates the relation between the amount $G_a$ of intake air and the vacuum $P_o$ of the operation chamber 18 of the back pressure transducer 24, namely, vacuum $P_o$ of the pressure control chamber 11. As in FIG. 2-A, the solid line shows results obtained when the air bleed 17 is provided, and the broken line shows results obtained when the air bleed 17 is not provided. In FIG. 2-B, $P_t$ represents the pressure in the operation chamber 18, namely, the pressure in the pressure control chamber 11 when the chamber 19 is completely opened to the atmospheric air. Since no venturi vacuum is acting on the chamber 19 at this point, this pressure Pt should naturally be a positive pressure. With an increase of the amount $G_a$ of intake air, vacuum is attained in the chamber 19 as pointed out hereinbefore, and the pressure in the pressure control chamber 11 is reduced below atmospheric pressure so that it is balanced with the vacuum in the chamber 19. When the air bleed 17 is provided, as in the case of FIG. 2-A, initiation of the reduction of the pressure $P_o$ in the pressure control chamber 11 is delayed to point A in FIG. 2-B.

FIG. 2-C illustrates the realtionship between the amount $G_a$ and the flow rate Q. According to this invention, Q remains substantially constant until point A corresponding to A in FIG. 2-A and is gradually increased after $G_a$ has passed Point A.

In the present invention, since the chamber 19 to be opened to the atmospheric air of the back pressure transducer is communicated with the venturi and opened to the atmospheric air through the air bleed, when the opening of the throttle blade 2 is not so large, the amount of the recirculated exhaust gas is not increased. Only when the throttle blade 2 is sufficiently opened is the amount of the recirculated exhaust gas increased. If the air bleed is not provided, the amount of the recirculated exhaust gas is directly increased as the opening of the throttle blade 2 becomes larger, and hence, there is a problem that the amount of the recirculated exhaust gas is increased excessively even during light load running not requiring a high exhaust gas recirculation rate. In the present invention, this problem can be solved by providing the air bleed.

What is claimed is:

1. A back pressure-controlled exhaust gas recirculation system (EGR system) in an internal combustion engine comprising a pressure-operated EGR valve means with a pressure control chamber disposed in an EGR conduit connecting an exhaust pipe to an intake pipe of the engine, said EGR valve means being provided with a pressure sensing pipe extending therefrom to a pressure source, and a back pressure transducer having an atmospheric pressure chamber connected to said pressure sensing pipe and having a pressure operation chamber connected to said pressure control chamber, wherein the improvement comprises an air bleed passage connected, at one end, to said atmospheric pressure chamber of said back pressure transducer and the other end of said air bleed passage opening into the atmospheric air, said air bleed passage being provided with a branch passage diverging therefrom and being connected to a venturi portion of a carburetor.

2. A back pressure-controlled EGR system in an internal combustion engine as set forth in claim 1, wherein said air bleed passage is therein provided with an air bleeding means to modify the venturi vacuum, said branch passage diverging from the portion of the air bleed passage disposed between the air bleeding means and the atmospheric chamber of the back pressure transducer.

* * * * *